US010196811B2

(12) United States Patent
Foerg et al.

(10) Patent No.: US 10,196,811 B2
(45) **Date of Patent: *Feb. 5, 2019**

(54) INSULATING SEALING ELEMENT FOR HEAD-OF-WALL JOINTS

(71) Applicant: Hilti Aktiengesellschaft, Schaan (LI)

(72) Inventors: Christian Foerg, Lamerdingen (DE); Manfred Klein, Kaufering (DE); Markus Koegler, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

This patent is subject to a terminal disclaimer.

(21) Appl. No.: 15/651,767

(22) Filed: Jul. 17, 2017

(65) Prior Publication Data

US 2017/0314257 A1 Nov. 2, 2017

Related U.S. Application Data

(62) Division of application No. 14/543,539, filed on Nov. 17, 2014, now abandoned.

(60) Provisional application No. 61/905,706, filed on Nov. 18, 2013.

(51) Int. Cl.

| | |
|---|---|
| ***E04B 1/64*** | (2006.01) |
| ***E04B 1/62*** | (2006.01) |
| ***E04B 2/74*** | (2006.01) |
| ***E04B 1/84*** | (2006.01) |
| ***E04B 1/94*** | (2006.01) |
| *E04B 1/82* | (2006.01) |

(52) U.S. Cl.

CPC ..... *E04B 1/62* (2013.01); *E04B 1/84* (2013.01); *E04B 1/948* (2013.01); *E04B 2/7411* (2013.01); *E04B 2001/829* (2013.01); *Y10T 428/23* (2015.01)

(58) Field of Classification Search

CPC ... E04B 1/62; E04B 1/84; E04B 1/948; E04B 2/7411; E04B 2001/829

See application file for complete search history.

(56) References Cited

U.S. PATENT DOCUMENTS

| | | | |
|---|---|---|---|
| 3,513,114 | A | 5/1970 | Vandersall |
| 4,805,364 | A | 2/1989 | Smolik |
| 4,854,096 | A | 8/1989 | Smolik |
| 5,010,702 | A | 4/1991 | Daw et al. |
| 5,127,203 | A | 7/1992 | Paquette |
| 5,127,760 | A | 7/1992 | Brady |

(Continued)

FOREIGN PATENT DOCUMENTS

CA 2 550 201 A1 12/2007

OTHER PUBLICATIONS

U.S. Patent Application, "Intumescent Sealing Element for Head-of-Wall Joints", U.S. Appl. No. 14/673,093, filed Mar. 30, 2015, Inventor: Manfred Klein et al.

(Continued)

*Primary Examiner* — Patrick J Maestri
(74) *Attorney, Agent, or Firm* — Crowell & Moring LLP

(57) ABSTRACT

An insulating strip is disclosed. The insulating strip includes a support layer and an insulating material strip secured to the support layer. The insulating material strip includes a first insulating material strip part and a second insulating material strip part where the first insulating material strip part and the second insulating material strip part are spaced apart from each other.

13 Claims, 7 Drawing Sheets

(56) References Cited

U.S. PATENT DOCUMENTS

| | | | | |
|---|---|---|---|---|
| 5,471,805 | A | 12/1995 | Becker | |
| 5,755,066 | A | 5/1998 | Becker | |
| 5,913,788 | A | 6/1999 | Herren | |
| 5,921,041 | A | 7/1999 | Egri, II | |
| 5,950,385 | A | 9/1999 | Herren | |
| 6,058,668 | A | 5/2000 | Herren | |
| 6,176,053 | B1 | 1/2001 | St. Germain | |
| 6,207,085 | B1 | 3/2001 | Ackerman | |
| 6,698,146 | B2 | 3/2004 | Morgan et al. | |
| 6,748,705 | B2 | 6/2004 | Orszulak et al. | |
| 6,783,345 | B2 | 8/2004 | Morgan et al. | |
| 7,043,880 | B2 | 5/2006 | Morgan et al. | |
| 7,152,385 | B2 | 12/2006 | Morgan et al. | |
| 7,240,905 | B1 | 7/2007 | Stahl, Sr. | |
| 7,617,643 | B2 | 11/2009 | Pilz et al. | |
| 7,681,365 | B2 | 3/2010 | Klein | |
| 7,752,817 | B2 | 7/2010 | Pilz et al. | |
| 7,814,718 | B2 | 10/2010 | Klein | |
| 7,866,108 | B2 | 1/2011 | Klein | |
| 7,950,198 | B2 | 5/2011 | Pilz et al. | |
| 8,056,293 | B2 | 11/2011 | Klein | |
| 8,087,205 | B2 | 1/2012 | Pilz et al. | |
| 8,132,376 | B2 | 3/2012 | Pilz et al. | |
| 8,136,314 | B2 | 3/2012 | Klein | |
| 8,151,526 | B2 * | 4/2012 | Klein | E04L 32/7457 52/1 |
| 8,181,404 | B2 | 5/2012 | Klein | |
| 8,281,552 | B2 | 10/2012 | Pilz et al. | |
| 8,322,094 | B2 | 12/2012 | Pilz et al. | |
| 8,353,139 | B2 * | 1/2013 | Pilz | E04L 31/948 52/232 |
| 8,375,666 | B2 | 2/2013 | Stahl, Jr. et al. | |
| 8,413,394 | B2 * | 4/2013 | Pilz | E04L 32/7411 52/207 |
| 8,468,759 | B2 | 6/2013 | Klein | |
| 8,499,512 | B2 | 8/2013 | Pilz et al. | |
| 8,555,566 | B2 | 10/2013 | Pilz et al. | |
| 2005/0032934 | A1 | 2/2005 | Muenzenberger et al. | |
| 2006/0137293 | A1 | 6/2006 | Klein | |
| 2011/0099928 | A1 | 5/2011 | Klein et al. | |
| 2011/0146180 | A1 | 6/2011 | Klein | |
| 2011/0167742 | A1 | 7/2011 | Klein | |
| 2011/0214371 | A1 | 9/2011 | Klein | |
| 2011/0247281 | A1 | 10/2011 | Pilz et al. | |
| 2012/0297710 | A1 | 11/2012 | Klein | |
| 2013/0031856 | A1 | 2/2013 | Pilz et al. | |
| 2013/0086859 | A1 | 4/2013 | Pilz et al. | |
| 2013/0091790 | A1 | 4/2013 | Stahl, Jr. et al. | |
| 2013/0118102 | A1 | 5/2013 | Pilz et al. | |
| 2013/0186020 | A1 | 7/2013 | Pilz | |
| 2013/0205694 | A1 | 8/2013 | Stahl, Jr. | |

OTHER PUBLICATIONS

U.S. Patent Application, "Insulating Sealing Element for Head-of-Wall Joints", U.S. Appl. No. 14/673,117, filed Mar. 30, 2015, Inventor: Manfred Klein et al.

U.S. Patent Application, "Insulating Sealing Element for Head-of-Wall Joints", U.S. Appl. No. 14/673,148, filed Mar. 30, 2015, Inventor: Manfred Klein et al.

U.S. Patent Application, "Insulating Sealing Element for Head-of-Wall Joints", U.S. Appl. No. 14/543,523, filed Nov. 17, 2014, Inventor: Herbert Muenzenberger et al.

* cited by examiner

INSULATING SEALING ELEMENT FOR HEAD-OF-WALL JOINTS

This application is a divisional of U.S. application Ser. No. 14/543,539, filed Nov. 17, 2014, which claims the benefit of U.S. Provisional Application No. 61/905,706, filed Nov. 18, 2013, the disclosures of which are expressly incorporated by reference herein.

BACKGROUND AND SUMMARY OF THE INVENTION

The present invention deals generally with the field of acoustical or firestopping insulation for head-of-wall joints, including, possibly, intumescent components.

In the building construction trade, a head-of-wall joint (also sometimes referred to as a top-of-wall joint) refers to the linear junction or interface existing between a top section of a framing or wallboard wall assembly and the ceiling, where the ceiling may be a next-level floor or corrugated pan roof deck, for example. Head-of-wall joints often present a serious challenge in terms of reducing or preventing the spread of smoke and fire during a building fire. In this regard and in common practice, a wall to ceiling connection of many newly constructed buildings consists essentially of metal framing assemblies. These metal framing assemblies are generally constructed from a plurality of metal framing members including studs, joints, trusses, and other metal posts and beams formed from sheet metal and frequently fabricated to have the same general cross-sectional dimensions as standard members used for similar purposes. Although many cross-sectional shapes are available, the primary shapes used in building construction are C-shaped studs and U-shaped tracks. These C-shaped studs and U-Shaped studs may vary in their size, which, however, are standardized. The steel track (or channel) is configured to receive steel studs between the legs of the shaped channel. A wallboard is generally attached to at least one side of the studs. The studs and wallboard are in many instances spaced apart from the ceiling a short gap distance in order to allow for ceiling deflections caused by seismic activity or moving overhead loads. Track and stud assemblies that allow for ceiling deflections are commonly referred to as dynamic head-of-wall systems. Exemplary steel stud wall constructions may be found in U.S. Pat. Nos. 4,854,096 and 4,805,364 both to Smolik, and U.S. Pat. No. 5,127,203 to Paquette. Exemplary dynamic head-of-wall systems having steel stud wall constructions may be found in U.S. Pat. No. 5,127,760 to Brady, and U.S. Pat. No. 6,748,705 to Orszulak et al.

Firestops are thermal barrier materials or combinations of materials used for filling gaps and openings such as in the joints between fire-rated walls and/or floors of buildings. For example, firestops can be used in walls or floors to prevent fire and smoke from passing through the gaps or openings required for cables, pipes, ducts, or other conduits. Firestops are also used to fill joint gaps that occur between walls, between a ceiling and the head-of-wall joints.

So-called head-of-wall joints pose a number of challenges for the fireproofing industry. Walls are increasingly being made of gypsum wallboard affixed to a framework of metal studs capped by a horizontally extending track. Ceilings are increasingly being made by pouring concrete onto fluted steel. Although the distance between the horizontally extending track at the top of the wall is often fixed in relationship to the ceiling, the gypsum wallboards are subject to expansion and contraction due to motion of other building components, ground settling, or other causes.

In order to contain the spread of smoke and fire, a fire resistant material such as, for example, mineral wool is often times stuffed into the gaps between the ceiling and wallboard (see, e.g., U.S. Pat. No. 5,913,788 to Herren). For example, mineral wool is often stuffed between a steel header track (e.g., an elongated U-shaped channel) and a corrugated steel roof deck (used in many types of steel and concrete building constructions); a fire resistant and generally elastomeric spray coating is then applied onto the exposed mineral wool to thereby form a fire resistant joint seal (see, e.g., U.S. Pat. No. 7,240,905 to Stahl). In certain situations where the ceiling to wallboard gap is relatively small, a fire resistant and elastomeric caulk is commonly applied so as to fill any small gaps. In still another approach and as disclosed in U.S. Pat. Nos. 5,471,805 and 5,755,066 both to Becker, a slidable non-combustible secondary wall member is fastened to an especially configured steel header track and immediately adjacent to the wallboard. In this configuration, the secondary wall member provides a fire barrier that is able to accommodate ceiling deflections. All of these approaches, however, are relatively labor intensive and thus expensive.

Intumescent materials have long been used to seal certain types of construction gaps such as, for example, conduit through-holes. In this regard, intumescent and fire barrier materials (often referred to as firestop materials or fire retardant materials) have been used to reduce or eliminate the passage of smoke and fire through openings between walls and floors and the openings caused by through-penetrations (i.e., an opening in a floor or wall which passes all the way through from one room to another) in buildings, such as the voids left by burning or melting cable insulation caused by a fire in a modern office building. Characteristics of fire barrier materials suitable for typical commercial fire protection use include flexibility prior to exposure to heat, the ability to insulate and/or expand, and the ability to harden in place upon exposure to fire (i.e., to char sufficiently to deter the passage of heat, smoke, flames, and/or gases). Although many such materials are available, the industry has long sought better and more effective uses of these materials and novel approaches for better fire protection, especially in the context of dynamic head-of-wall construction joints and gaps.

Thus, and although construction joints and gaps are generally sealed in some manner (e.g., mineral wool and/or elastomeric coatings; see also, U.S. patent application Ser. No. 2006/0137293 to Klein), there are relatively few products and methods available that effectively and efficiently seal head-of-wall construction joints and gaps to thereby significantly enhance the ability of such joints and gaps to withstand smoke and fire penetration. In particular, there are very few products and methods available that address the needs for adequate fire protection and sealing of dynamic head-of-wall systems associated with steel stud wall constructions.

Recently more advanced head-of-wall fire block arrangements have been developed based on fire block header tracks. These fire block header tracks utilize an expandable fire-resistant material, such as an intumescent material, applied along a length of the header track of a wall assembly. The intumescent material is either positioned on the web of the header track, on the legs (hereinafter also referred to as a flange) of the header track or alternatively wraps around a corner of the header track, extending both along a portion of a web of the header track and a flange of the header track. The intumescent material advantageously is held in place between the web of the header track and the floor or ceiling above the wall. When exposed to a sufficient temperature, the intumescent material expands to fill gaps at the head-of-wall. The portion of the intumescent trapped between the header track and the floor or ceiling ensures that the intumescent stays in place as it expands and does not become dislodged as a result of the expansion.

With the use of such fire-resistant material, the metal tracks often require a unique construction on the exterior surface of the metal track which can have a predefined area such as a recess or the like which identifies the specific location required for placement of such an intumescent and/or acoustic layer of insulation material. In particular, as the joint moves responsive to normal expansion and contraction of the building components, the insulating tape and/or the coatings of insulating material which is attached directly to the surfaces of flanges can become dislodged from components of the head-of-wall area, that is, particularly dislodging from the surfaces of the downwardly extending side sections of the track or runner. Also these systems do not specifically address variations in the contour or profile of the ceiling or roof area which comes into direct abutment with the upper portion of the metal track. Such variations in the configuration of the building construction in this area can form gaps between the track and the adjacent roof or ceiling area which are not adequately addressed for insulation by the above described prior art systems.

A further significant disadvantage of the prior art head-of-wall fire block arrangements is that they consist of an intumescent insulating material which expands up to ten times its normal thickness when exposed to sufficient heat. In order to achieve such high expansion, a material comprising additives, which additives cause the swelling of the material, must be used. These additives, however, are expansive making the insulating material expensive.

One of the advantages of the apparatus of the present invention is that it is usable with conventionally OEM metal track construction and does not require any customized design for the ceiling runner, primarily, because the present construction works best when not attached in any manner to the track side surfaces sections particularly where it is important to allow for some amount of relative movement therebetween during normal expansion and contraction of building materials and sections which occurs commonly. The inventors now have found out that it is not necessary to use an intumescent material as firestop material in order to provide reliable fire prevention provided that the material is fire resistant, i.e., material must not burn away but builds a stable ash crust.

It is an object of the sealing element for insulating head-of-wall joints of the present invention to effectively seal between conventionally designed metal track sections and the immediately adjacent roof or ceiling area for firestopping and/or acoustic insulating thereof.

It is an object of the sealing element for insulating head-of-wall joints of the present invention to be usable with conventional steel framing and gypsum board wall constructions.

It is an object of the sealing element for insulating head-of-wall joints of the present invention to be usable with floor or roof constructions of any conventional construction including solid concrete or a composite material installed atop a corrugated steel deck.

It is an object of the sealing element for insulating head-of-wall joints of the present invention to prevent the spread of sound, noise, fire, super-heated gases, flames and/or smoke in these areas.

It is an object of the sealing element for acoustical and/or thermal insulating head-of-wall joints of the present invention to provide more effective insulating by providing attachment of the insulating material to the metal track only in the central upper portion thereof or at the lowermost edges of the track side walls without any attachment whatsoever to the surfaces of the downwardly extending track side sections to facilitate insulating therearound irrespective of the normal expansion and contraction of building structural components that takes place over the time period prior to the occurrence of the fire conditions.

It is an object of the sealing element for insulating head-of-wall joints of the present invention to minimize cost and maintenance requirements.

It is an object of the sealing element for insulating head-of-wall joints of the present invention to expedite installation and minimize labor costs.

Many patents have been applied or granted for various constructions for insulating head-of-wall joints as described above such as shown in U.S. Patent Application Publication No. 2011/247281 A1 published Oct. 13, 2011 to Don A. Pilz et al. assigned to California Expanded Metal Products Company on a "FIRE-RATED WALL CONSTRUCTION PRODUCT"; U.S. Patent Application Publication No. 2013/031856 A1 published Feb. 7, 2013 to Don A. Pilz et al. assigned to California Expanded Metal Products Company on a "FIRE-RATED WALL CONSTRUCTION PRODUCT"; U.S. Pat. No. 8,281,552 B2 patented Oct. 9, 2012 to Don A. Pilz et al. assigned to California Expanded Metal Products Company on an "EXTERIOR WALL CONSTRUCTION PRODUCT"; U.S. Pat. No. 8,499,512 B2 patented Aug. 6, 2013 to Don A. Pilz et al. assigned to California Expanded Metal Products Company on an "EXTERIOR WALL CONSTRUCTION PRODUCT"; U.S. Patent Application Publication No. 2013/0086859 A1 published Apr. 11, 2013 to Donald A. Pilz et al. assigned to California Expanded Metal Products Company on a "FIRE-RATED WALL AND CEILING SYSTEM"; U.S. Pat. No. 7,617,643 B2 patented Nov. 17, 2009 to Donald A. Pilz et al. assigned to California Expanded Metal Products Company on a "FIRE-RATED WALL AND CEILING SYSTEM"; U.S. Pat. No. 7,950,198 B2 patented May 31, 2011 to Donald A. Pilz et al. assigned to California Expanded Metal Products Company on a "FIRE-RATED WALL AND CEILING SYSTEM"; U.S. Pat. No. 8,087,205 B2 patented Jan. 3, 2012 to Don A. Pilz et al. assigned to California Expanded Metal Products Company on a "FIRE-RATED WALL AND CEILING SYSTEM"; U.S. Pat. No. 8,322,094 B2 patented Dec. 4, 2012 to Don A. Pilz et al. assigned to California Expanded Metal Products Company on a "FIRE-RATED WALL AND CEILING SYSTEM"; U.S. Pat. No. 7,752,817 B2 patented Jul. 13, 2010 to Don A. Pilz et al. assigned to California Expanded Metal Products Company on a "TWO-PIECE TRACK SYSTEM"; U.S. Pat. No. 8,132,376 B2 patented Mar. 13, 2012 to Don A. Pilz et al. assigned to California Expanded Metal Products Company on a "TWO-PIECE TRACK SYSTEM"; U.S. Pat. No. 8,413,394 B2 patented Apr. 9, 2013 to Don A. Pilz et al. assigned to California Expanded Metal Products Company on a "TWO-PIECE TRACK SYSTEM"; U.S. Pat. No. 8,555,566 B2 patented Oct. 15, 2013 to Don A. Pilz et al. assigned to California Expanded Metal Products Company on a "TWO-PIECE TRACK SYSTEM"; U.S. Patent Application Publication No. 2011/214371 A1 published Sep. 8, 2011 to James A. Klein assigned to Blazeframe Ind. Ltd. on an "OFFSET LEG FRAMING ELEMENT FOR FIRE STOP APPLICATIONS"; U.S. Pat. No. 8,468,759 B1 patented Jun. 25, 2013 to James A. Klein assigned to Blazeframe Ind. Ltd. on a "FIRE RETARDANT COVER FOR FLUTED ROOF DECK"; U.S. Patent Application Publication No. 2011/146180 A1 published Jun. 23, 2011 to James A. Klein assigned to Blazeframe Ind. Ltd. on an "ACOUSTICAL AND FIRESTOP RATED TRACK FOR WALL ASSEMBLIES HAVING RESILIENT CHANNEL MEMBERS"; U.S. Patent Application Publication No. 2011/167742 A1 published Jul. 14, 2011 to James A. Klein assigned to Blazeframe Ind. Ltd. on "HEAD-OF-WALL FIREBLOCK SYSTEMS AND RELATED WALL ASSEMBLIES"; U.S. Pat. No. 7,681,365 B2 patented Mar. 23, 2010 to James A. Klein on "HEAD-OF-WALL FIREBLOCK SYSTEMS AND RELATED WALL ASSEMBLIES"; U.S. Pat. No. 7,814,718 B2 patented Oct. 19, 2010 to James A. Klein on "HEAD-OF-WALL FIREBLOCKS"; U.S. Pat. No. 7,866,108 B2 patented Jan. 11, 2011 to James A. Klein on "HEAD-OF-WALL FIREBLOCK SYSTEMS AND RELATED WALL ASSEMBLIES"; U.S. Pat. No. 8,056,293 B2 patented Nov. 15, 2011 to James A. Klein on "HEAD-OF-WALL FIREBLOCK SYSTEMS AND RELATED WALL ASSEMBLIES"; U.S. Pat. No. 8,136,314 B2 patented Mar. 20, 2012 to James A. Klein on "HEAD-OF-WALL FIREBLOCKS"; U.S. Pat. No. 8,151,526 B2 patented Apr. 10, 2012 to James A. Klein on "HEAD-OF-WALL FIREBLOCK SYSTEMS AND RELATED WALL ASSEMBLIES"; U.S. Patent Application Publication No. 2012/0297710 A1 published Nov. 29, 2012 to James A. Klein on "CONTROL JOINT BACKER AND SUPPORT MEMBER ASSOCIATED WITH STRUCTURAL ASSEMBLIES"; U.S. Patent Application Publication No. 2011/0099928 A1 published May 5, 2011 to James A. Klein and Alastair Malcolm on "DEFELCTION AND DRIFT STRUCTURAL WALL ASSEMBLIES"; CA Patent Application Publication No. 2550201 A1 published Dec. 15, 2007 to James A. Klein on "HEAD-OF-WALL FIREBLOCKS AND RELATED WALL ASSEMBLIES"; U.S. Pat. No. 8,181,404 B2 patented May 22, 2012 to James A. Klein on "HEAD-OF-WALL FIREBLOCKS AND RELATED WALL ASSEMBLIES"; U.S. Patent Application Publication No. 2013/0186020 A1 published Jul. 25, 2013 to Don A. Pilz assigned to California Expanded Metal Products Company on a "FIRE-RATED JOINT SYSTEM"; U.S. Pat. No. 8,353,139 B2 patented Jan. 15, 2013 to Don A. Pilz et al. assigned to California Expanded Metal Products Company on a "WALL GAP FIRE BLOCK DEVICE, SYSTEM AND METHOD"; U.S. Patent Application Publication No. 2013/118102 A1 published May 19, 2011 to Don A. Pilz et al. assigned to California Expanded Metal Products Company on a "WALL GAP FIRE BLOCK DEVICE; SYSTEM AND METHOD"; U.S. Patent Application Publication No. 2013/205694 A1 published Aug. 15, 2013 to James P. Stahl assigned to Specified Technologies Inc. on "INSULATING GASKET CONSTRUCTION FOR HEAD-OF-WALL JOINTS"; U.S. Pat. No. 8,375,666 B2 patented Feb. 19, 2013 to James P. Stahl et al. assigned to Specified Technologies Inc. on "FIRESTOPPING SEALING MEANS FOR USE WITH GYPSUM WALLBOARD IN HEAD-OF-WALL CONSTRUCTION"; U.S. Patent Application Publication No. 2013/091790 A1 published Apr. 18, 2013 to James P. Stahl et al. assigned to Specified Technologies Inc. on "FIRESTOPPING MEANS FOR USE WITH GYPSUM WALLBOARD IN HEAD-OF-WALL CONSTRUCTION"; U.S. Pat. No. 7,240,905 B2 patented Jul. 10, 2007 to James P. Stahl on "METHOD AND APPARATUS FOR SEALING A JOINT GAP BETWEEN TWO INDEPENDENTLY MOVABLE STRUCTURAL SUBSTRATES"; U.S. Pat. No. 6,698,146 B2 patented Mar. 2, 2004 to Michael D. Morgan et al. assigned to W.R. Grace & Co.-Conn. on "IN SITU MOLDED THERMAL BARRIERS"; U.S. Pat. No. 6,783,345 B2 patented Aug. 31, 2004 to Michael D. Morgan et al. assigned to W.R. Grace & Co.-Conn. on "IN SITU MOLDED THERMAL BARRIERS"; U.S. Pat. No. 7,043,880 B2 patented May 16, 2006 to Michael D. Morgan et al. assigned to W.R. Grace & Co.-Conn. on "IN SITU MOLDED THERMAL BARRIERS"; U.S. Pat. No. 7,152,385 B2 patented Dec. 26, 2006 to Michael D. Morgan et al. assigned to W.R. Grace & Co.-Conn. on "IN SITU MOLDED THERMAL BARRIERS"; U.S. Pat. No. 5,010,702 patented Apr. 30, 1991 to T. L. Daw et al. and assigned to Daw Technologies, Inc. on a "Modular Wall System"; and U.S. Pat. No. 5,127,203 patented Jul. 7, 1992 to R. F. Paquette on a "Seismic/Fire Resistant Wall Structure and Method"; and U.S. Pat. No. 5,755,066 patented May 26, 1998 to D. W. Becker on a "Slip Track Assembly"; and U.S. Pat. No. 5,913,788 patented Jun. 22, 1999 to T. R. Herren on a "Fire Blocking And Seismic Resistant Wall Structure"; and U.S. Pat. No. 5,921,041 patented Jul. 13, 1999 to J. D. Egri, II on a "Bottom Track For Wall Assembly"; and U.S. Pat. No. 5,950,385 patented Sep. 14, 1999 to T. R. Herren on an "Interior Shaft Wall Construction"; and U.S. Pat. No. 6,058,668 patented May 9, 2000 to T. R. Herren on a "Seismic And Fire-Resistant Head-of-Wall Structure"; and U.S. Pat. No. 6,176,053 patented Jan. 23, 2001 to Roger C. A. St. Germain and assigned to Robert C. A. St. Germain on a "Wall Track Assembly And Method For Installing The Same".

Although the known fire block header tracks provide exceptional performance, there still exists a need for fire block arrangements that can be applied to any desired structure, such as the top of a stud wall assembly or to header tracks. Furthermore, as described herein, preferred embodiments of the wall gap fire blocks can be applied to a wall bottom track to protect a foot-of-wall gap or a (vertical or horizontal) gap in a location other than the head or foot of a wall. In addition, the intumescent material in the known fire block header tracks preferably is applied at the factory during the manufacturing process. In some circumstances, it may be desirable to apply the insulating material on site. Thus, certain preferred embodiments of the present fire blocks are well-suited to application on the job site.

Preferred embodiments of the present invention provide an optional adhesive insulating material strip that can be applied to a header track or other head-of-wall structure to create a head-of-wall insulation block, including, fire block. The adhesive insulation strip may include strip portions of another material, among other material portions, if desired.

The insulating strip comprises at least one insulating material strip, optionally a cover layer that covers the insulating material strip and optionally a support layer that covers the other surface of the insulating material strip.

The insulating material strip will preferably include a fire-resistant material or an acoustically insulating material. The term "fire-resistant material" shall include a non-inflammable material, a flame-proof material, that is flame-proof by itself, or a material comprising additives to make the material flame-proof. The material shall form a stable ash crust in case of fire. The fire-resistant materials also may optionally include intumescent materials. These intumescent materials may be constructed partially or entirely from an intumescent material such as CP 646 from Hilti, for example. It also can be made solely from an acoustical insulating material for applications where sound transmissions are found to be desirable. Such acoustical insulating configurations can preferably be formed of a felt acoustical insulating material. Alternatively, it can be formed of a foamed insulating material. It is also possible for the insulating material of the present invention to have components of both fire-resistant and acoustical sealing therewithin.

The insulating material may preferably be constructed partially or entirely from a pressure-resistant material such as acrylate based polymer or a hard putty such as rubber, e.g., polyisobutylene based rubber. These materials may comprise a reinforcing member such as glass fibers or a glass fiber fabric to enhance strength of the material. The term "pressure-resistant" means that while installing the wallboard, the material shall be deformed only slightly so that in case of vertical movement of the wallboard tilting and entanglement of the insulating material are always avoided.

In another embodiment the insulating material may be constructed partially or entirely from a compressible material such as plasticines, fabric (non-woven or woven) or a felt, e.g., glass fiber braid, glass fiber fabric or glass fiber mat. Plasticines, which are also referred to as putties, are frequently used for this application. They generally consist of a liquid polymer such as butyl rubber, plasticizers (paraffin oil, phthalates, adipates, etc.) and fillers, with a filler content of up to 80 percent. In particular the plasticine contains, as liquid polymer, at least one representative of the group comprising polyurethanes, polyvinyl acetates, polyvinyl ethers, polyvinyl propionates, polystyrenes, natural or synthetic rubbers, poly((meth)acrylates) and homopolymers and copolymers based on (meth)acrylates, acrylonitrile, vinyl esters, vinyl ethers, vinyl chloride and/or styrene, preferably poly(alkyl methacrylate), poly(alkyl acrylate), poly(aryl methacrylate), poly(aryl acrylate) and/or copolymers thereof with n-butyl acrylate and/or styrene. The plasticine may comprise fire-protection additives. In this regard reference is made to the U.S. patent application Ser. No. 2005/032934 A1 which is incorporated in its entirety herein by reference.

More preferably the insulating material is also abrasive-resistant to resist abrasion caused by the wall member rubbing against the insulating material when moving up and down to movement of the building.

Enhanced strength or reinforcement of the material can be provided by including a reinforcing cover layer (hereinafter also referred to as cover layer) on one side of the insulating material. This is important in particular when the insulating material strip itself is made from a soft and more or less compressible material. In case the insulating material is hard and pressure-resistant the facing member can be omitted. However, as a matter of precaution and for aesthetic reasons a hard and/or pressure-resistant material may also be provided with a facing member. Preferably the cover layer is made of an abrasion-resistant material to avoid abrasion resulting in loss of the insulating material caused by repeatedly rubbing of the wallboard over the insulating material. The cover layer can be a film material, preferably a synthetic film like plastic or poly-type material such as polyalkylene material, for example polyethylene material. Alternatively the cover layer can be a fabric made of abrasion-resistant fibers, like glass fibers or any other suitable material. The cover layer provides protection in the event that the wall is designed to accommodate vertical movement, which could result in the wallboard rubbing against the insulating material. However, the facing member still permits the insulating material to expand in case it comprises an intumescent material. In one embodiment the cover layer has a printable surface. A positioning aid can be provided by including a mark in form of an optionally colored line on the cover layer which helps to affix the insulating strip on the header track in an ideal position. This may be important in case the insulating strip extends beyond the surface of the web of the header track, in particular when the insulating strip is installed on site.

After having attached the insulating material to the track the cover layer will constitute the outer surface of the material. The cover layer will be in contact with either the ceiling or wallboard or both the ceiling and the wallboard.

In case the insulating material will be positioned only or partially on the web of the track, the cover layer can be omitted on the portion of the insulating material which is aligned with the web, since the material is secured to the ceiling by fixing the track to the support structure like the ceiling so that no movement between the ceiling or other part of the wall assemblies and the insulating material takes place that would cause abrasion of the material.

In one embodiment the cover layer includes both the fabric and the synthetic film, whereas preferably the film constitutes the outer surface of the insulating strip so that the fabric is positioned between the insulating material and the synthetic film.

In each of the various embodiments the cover layer does not extend beyond the insulation material. The cover layer is of the same size as the insulating material or insulating material portion.

In one embodiment, a support layer covers one side of the insulating material. Preferably, the support layer and the cover layer are positioned on opposite sides of the insulating material strip to cover the insulating material strip so that the insulating material is positioned between the support layer and the cover layer. The support layer is preferably of the same size as the insulating material strip.

In one embodiment the insulating strip includes two separate, i.e., spatially separated insulating material strips so that the insulating material strips are arranged at a certain distance from each other, and includes one support layer on which both insulating material strips arranged. The insulating strip defines a track receiving area therebeneath and is adapted to receive the header track or other construction product therewithin. The support layer connects the two insulating material strips, whereas a middle portion of the support member is free of insulating material, i.e., does not have an insulating material positioned thereon. The distance between the two insulating material strips, i.e., the size of the middle portion of the support layer, depends on the width of the header track or other head-of-wall structure to which the insulating strip shall be attached. If, for example, the insulating strip shall be attached to only the legs of the header track, the size of the support layer is adapted so that the middle portion of the support member extends over the web of the header track.

The underneath surface of the insulating material strip or in case the insulating strip includes a support layer the underneath surface of the support layer may include an adhesive, if desired. In the latter case, an adhesive may be provided on the underneath surfaces of both the insulating material strip and the support layer. Preferably a removable protective layer covers the underneath surface of the entire insulating material strip and/or the support layer until the insulating strip is ready to be applied. In case the insulating material strip is made of a sticky material such as soft or hard putty an adhesive will not be necessary since the material itself provides sufficient adhesive power to the insulating strip.

In another embodiment the insulating strip comprises two insulating material strips positioned adjacent to one another, preferably in direct abutment with each other (herein also referred to as two-part insulating material strip). In this arrangement, the insulating material may be of any of the materials described above and may be same or different. In one arrangement the insulating material is the same insulating material. In another arrangement the insulating strip is composed of two different insulating materials. Preferably the materials also differ in their texture so that, for example, an abrasion-resistant and optionally also pressure-resistant material constitutes one part of the insulating strip and a soft, compressible material constitutes the other part. For example the insulating strip may be formed of an acrylate based polymer and the other part of the insulating strip may be formed of soft putty.

The cover layer may also be formed as a two-part layer, so that each insulating material is covered by a separate cover layer. Alternatively the cover layer is formed as a single layer to cover both insulation material portions.

It is to be understood that the cover layer as well as the support layer are only optional, and, therefore, not always necessary. Their use strongly depends on the materials used for the insulating material and depends on the type of application.

Moreover, various combinations of cover layer and support layer are possible. In view of the embodiments discussed in more detail with reference to the examples, it is possible to use only a support layer without a cover layer; or to combine a continuous support layer with a cover layer only on the pressure-resistant and/or abrasive-resistant material portion, in particular where a combination of different insulating materials is used, in particular a combination of a pressure-resistant and/or abrasive-resistant with a soft material (e.g., soft putty); or to combine a continuous cover layer with a support layer only on the pressure-resistant and/or abrasive-resistant material, in particular where a combination of different insulating materials is used, in particular a combination of a pressure-resistant and/or abrasive-resistant with a soft material (e.g., soft putty). It is contemplated that various aspects and features of the invention described can be practiced separately, combined together, or substituted for one another, and that a variety of combinations and subcombinations of the features and aspects can be made and still fall within the scope of the invention. Thus, it is intended that the scope of the invention herein disclosed should not be limited by the particularly disclosed embodiments described above and below, but should be determined only by a fair reading of the claims.

The insulating strip can be applied to a header track or other construction product, such as a bottom track, metal stud, metal flat strap or any other framing member that needs an open gap between the wallboard and a perimeter structure, in particular for movement (deflection or drift) but not restricted thereto. In other words, the elongated insulating strip can be used for sealing any open gap between the wallboard and the construction product or between the construction product and a perimeter structure, like the support structure, for example floor, side walls or ceiling. The insulating strip allows the gap to stay open for movement and provides fire and smoke protection and/or sound reduction. Preferably, the insulating strip is applied so that it wraps the upper corner of the header track or other head-of-wall structure.

In one arrangement where the insulating strip comprises two insulating material strip portions one material strip portion may be positioned on the top of the header track or other head-of-wall structure to provide a smoke, air and sound seal at the head-of-wall. The other material strip portion may be positioned on a side flange of the header track or side surface of the other head-of-wall structure so that the other material portion is positioned between the header track or other head-of-wall structure and the wallboard.

The compressible material strip portion may be positioned on the top of the header track or other head-of-wall structure to provide a smoke, air and sound seal at the head-of-wall. The pressure-resistant material strip portion may be positioned on a side flange of the header track or side surface of the other head-of-wall structure so that the pressure-resistant portion is positioned between the header track or other structure product and the wallboard.

A further detailed embodiment of the two-part material portioned strip is adapted and applied to a slotted header track having a plurality of slots. The insulating material strip is divided into two material portions which include different materials. Preferably the first material strip which shall align with the slotted portion of the leg of the header track includes a pressure-resistant and preferably also an abrasive-resistant material, for example an acrylate-based material. The second material portion which shall align with the non-slotted upper portion of the leg of the header track preferably includes a compressible material, for example a putty or a foamed material. Both material portions may be covered by a cover layer. Preferably the material strips are provided with an adhesive (not shown) to secure the material strips to the support layer. In this embodiment, the first material strip portion is adapted to the slotted structure of the track by subdividing the material strip portion into a plurality of small stripes. This results in the material strip portion being interrupted by portions which are free of insulating material. In other words, the insulating material portion includes alternating portions with insulating material and portions free of insulating material. The material stripes are aligned with the leg portions and fixed thereto preferably with an adhesive so that the portion of the material strip free of insulating material is aligned with the slots. The material stripes may be positioned parallel to the slots so that slots and strips alternate. Alternatively the material stripes may also be positioned in such a manner that the stripes diagonally cover the slots. In this arrangement the screws with which the studs are movably fixed to the slotted header track may cut through the diagonal material stripes resulting in insulating remaining material sections on both sides of the slots which still assure sufficient sealing against smoke, fire and sound. In this embodiment the cover layer serves as the insulating element and serves as sealing.

The thickness of the material strip and with this also of the material stripes depends on the screws or the like used to fix the studs to the header track. Preferably the thickness of the insulating material corresponds to the thickness of the head of the screws protruding beyond the leg, whereas movement of the screw still must be possible. This provides sufficient sealing of the gap whilst ensuring at the same time a movement of the screws. The insulating strip may be installed before or after fixation of the header track and the studs. The insulating strip is positioned so that its top edge extends above the top surface of the web. In this configuration the insulating strip contacts the horizontal support structure, e.g., a ceiling, and provides for enhanced sound and smoke containment especially in cases of an uneven or spawled horizontal support structure surface. But the thickness highly dependent on the intended use of the insulation strip.

The above-described and other features, aspects and advantages of the present invention are described below with reference to drawings of preferred embodiments, which are intended to illustrate, but not to limit, the invention.

DETAILED DESCRIPTION OF THE DRAWINGS

FIGS. 1*a* to 1*d* illustrate various types of an elongated insulating strip assembly 1, which is also referred to herein as an insulating strip, according to preferred embodiments of the present invention.

Figure 1A:
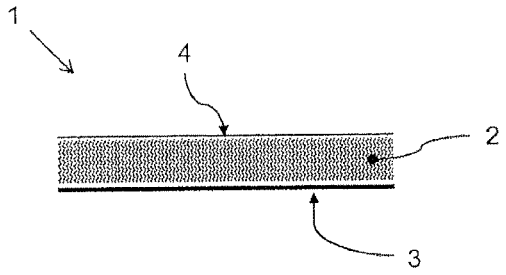
FIG. 1*a* is a cross-sectional view of a first embodiment of the insulating strip assembly having certain features, aspects and advantages of the present invention.

FIG. 1*a* illustrates an elongated insulating strip assembly 1 according to a first embodiment of the present invention. The insulating strip 1 is an elongate strip assembly that preferably is constructed as an integrated assembly of multiple components. The insulating strip 1 may be supplied on a roll, in a folded arrangement or any other suitable manner. Preferably, the insulating strip 1 is provided as a separate component that is applied to a head-of-wall in the field, as is described in greater detail below.

The illustrated insulating strip 1 includes a fire-resistant material strip portion 2 ("insulating material strip 2") and a support layer 3. A cover layer 4 covers the insulating material strip 2. The cover layer 4, however, does not include side portions that extend outwardly from the insulating material strip 2. The cover layer 4 covers only the insulating material strip 2. In such an arrangement, the insulating strip 1 may be secured to a construction product by an adhesive (not shown) applied to the bottom of the strip. An additional adhesive may be applied to the upper face of the insulating material strip 2 to secure the insulating material strip 2 to the cover layer 4.

The insulating material strip 2 may be constructed from putty that may additionally contain intumescent additives or from an inorganic fiber material such as a felt, fabric or the like made from glass fibers. In case the insulating material is made from putty, the putty may be provided with a supporting structure, in particular internal supporting structure, such as a web or fabric, in particular metal or glass fiber web or fabric.

For the first embodiment the insulating material preferably is made from putty, in particular soft putty, felt or felt like material.

Preferably, a removable protective layer (not shown) covers the underneath surface of the insulating strip 1. The cover layer provides protection in the event that the wall is designed to accommodate vertical deflection, which could result in the wallboard rubbing against the insulating material, leading to loss of insulating material for example. In addition, the cover layer includes an adhesive layer (not shown) on the underneath side that faces the insulating material strip 2 and protective layer. Thus, in some arrangements, the cover layer 4 is a tape, such as a polypropylene tape, also referred to herein as poly tape. Other suitable tapes may also be used. The cover layer 4 may be clear or somewhat clear so that the insulating material strip 2 is visible through the cover layer 4 to ease assembly onto a header track or other head-of-wall structure. In addition or in the alternative, a marking (such as a mark line) may be provided on the outer (upper) surface of the cover layer 4 to indicate the location of the edge between the web and the leg of the header track. The marking can be used to locate the insulating strip 1 relative to the structure on which it is placed, such as the edge of a top or bottom track, for example.

Figure 1B:
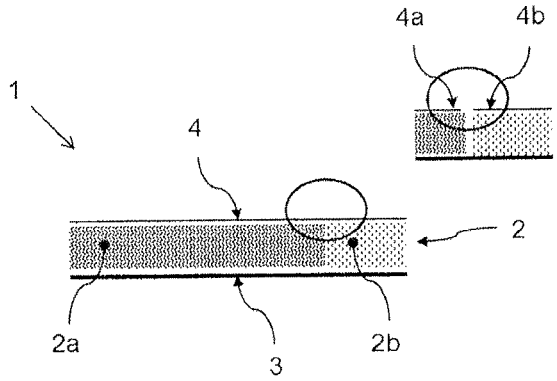
FIG. 1*b* is a cross-sectional view of second embodiment of the insulating strip assembly having certain features, aspects and advantages of the present invention.
Figure 1C:
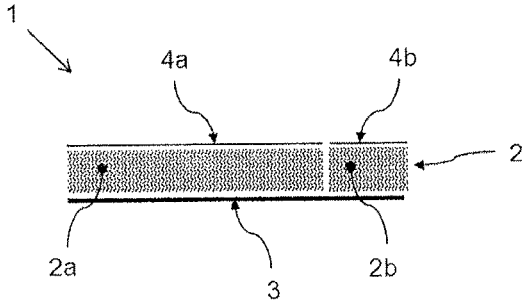
FIG. 1*c* is a cross-sectional view of a third embodiment of the insulating strip assembly having certain features, aspects and advantages of the present invention.

FIGS. 1*b* and 1*c* illustrate elongated insulating strip assemblies 1 according to a second (FIG. 1*b*) and third (FIG. 1*c*) embodiment of the insulating strip 1 of the present invention, which are similar to the insulating strip assembly 1 of FIG. 1*a*. Accordingly, the same reference numbers are used to indicate the same or similar components or features between these embodiments. According to the second embodiment shown in FIG. 1*b* the intumescent material strip 1 is divided into two portions 2*a* and 2*b* including different insulating materials. According to the third embodiment shown in FIG. 1*c* the intumescent material strip 1 is also divided into two portions 2*a* and 2*b* but including the same material. The cover layer 4 may also be divided into two portions 4*a* and 4*b* as best shown in the encircled view in FIG. 1*b*, which also holds for the cover layer 4 of the embodiment shown in FIG. 1*c*.

Figure 1D:
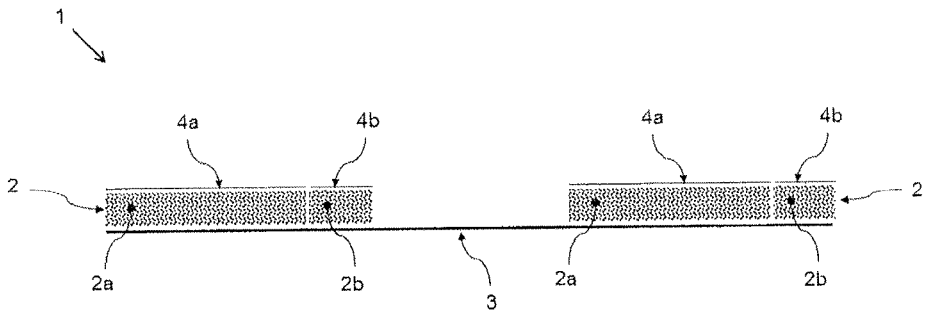
FIG. 1*d* is a cross-sectional view of a fourth embodiment of the insulating strip assembly having certain features, aspects and advantages of the present invention.

FIG. 1*d* illustrates an elongated insulating strip assembly 1 according to a fourth embodiment of the insulating strip 1 of the present invention, which is very similar to the insulating material strip assembly 1 of FIG. 1*c*. The difference between the assembly of FIG. 1*c* and FIG. 1*d* is that the insulating strip 1 in FIG. 1*d* comprises two identical two part material strips 2 including two part cover layers 4 and a support layer 3 which supports both material strips 2. Accordingly, the width of the support layer 3 is more than twice the width of the support layer 3 of the insulating strip 1 shown in FIG. 1*c*. The insulating strip 1 shown in FIG. 1*d* comprises a portion without an insulating material between the two portions, in particular the side portions which comprise an insulating material.

Figure 2:
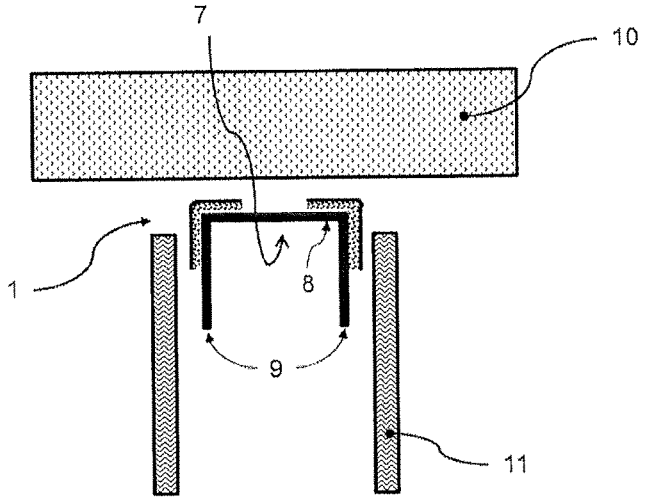
FIG. 2 is a cross-sectional view of a portion of a stud wall assembly with the insulating strip assembly of FIG. 1*a* installed at the head-of-wall according to one embodiment of the present invention.

FIG. 2 illustrates the insulating strip 1 of FIG. 1*a* applied to a head-of-wall structure including a header track 7 with a web 8 and legs 9 extending downwardly from the web at opposite sides of the track and a plurality of studs (not shown). The insulating strip 1 is applied with a portion of the insulating strip 1 between the web 8 of the header track 7 and the horizontal support structure 10 and a portion between one leg 9 of the header track 7 and the wallboard 11. The insulating strip 1 wraps one corner of the header track 7. As discussed above, the insulating strip 1 may include a marking to assist in the proper positioning on the corner of the header track 7, such as a linear marking, for example. Alternatively, the insulating strip 1 may comprise two separate insulating material portions 2 that are arranged on opposing edge sections of the support layer 3 (arrangement not shown), so that one insulating material portion will wrap one corner of the header track 7 and the other insulating material portion 2 will wrap the other opposing corner of the header track 7.

Figure 3:
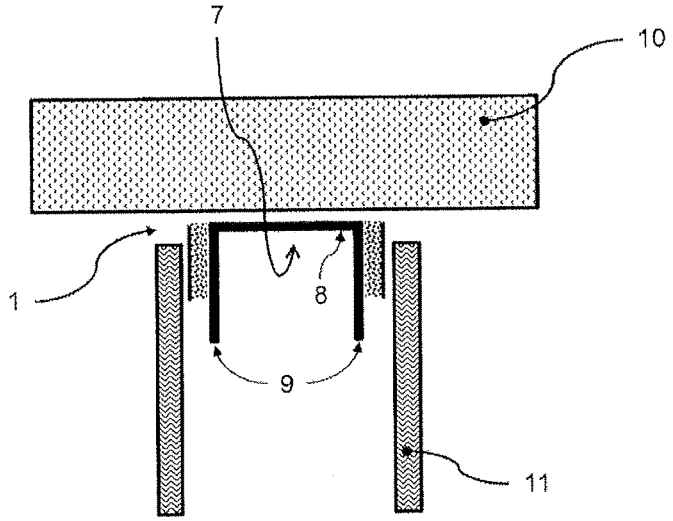
FIG. 3 is a cross-sectional view of a portion of a stud wall assembly with the insulating strip assembly of FIG. 1*a* installed at the head-of-wall in an alternative way according to another embodiment of the present invention.
Figure 4:
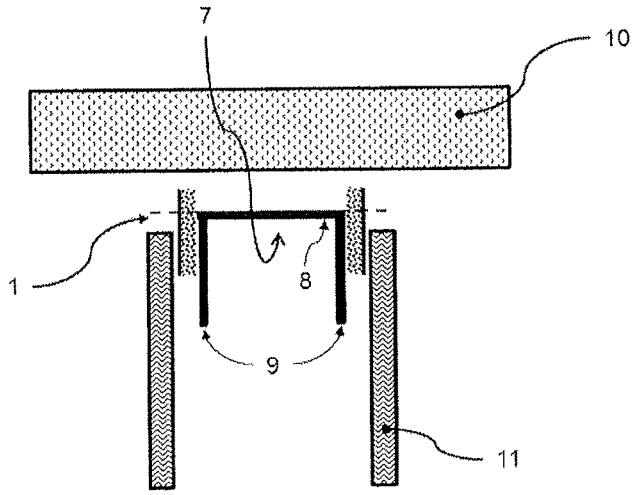
FIG. 4 is a cross-sectional view of a portion of a stud wall assembly with the insulating strip assembly of FIG. 1*a* installed at the head-of-wall in an alternative way according to another embodiment of the present invention.

As shown in FIG. 3 the insulating strip 1 of FIG. 1*a* is affixed lengthwise on at least one, preferably both legs 9 of the header track 7. The insulating strip 1 is positioned so that its top edge 5 does not extend above the top surface of the web 8. In this configuration the insulating strip 1 does not necessarily contact the horizontal support structure 10, e.g., a ceiling. Preferably, the insulating strip 1 is positioned so that its top edge 5 extends slightly above the top surface of the web 8 as is best shown in FIG. 4. In this configuration the insulating strip 1 contacts the horizontal support structure 10, e.g., a ceiling, and provides for enhanced sound and smoke containment especially in cases of an uneven or spawled horizontal support structure surface.

Figure 5:
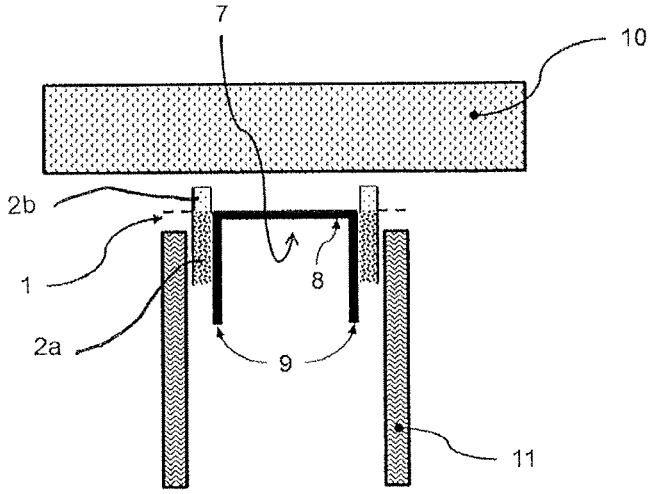
FIG. 5 is a cross-sectional view of a portion of a stud wall assembly with the insulating strip assembly of FIG. 1*b* installed at the head-of-wall in an alternative way according to another embodiment of the present invention.

This effect of enhanced sound and smoke sealing obtained by the configuration shown in FIG. 4 will further be enhanced in case the intumescent material strip 1 is configured as a two-part material strip as best shown in FIG. 5, i.e., the insulating material strip is divided into two portions 2*a* and 2*b* so that the two portions consists of different materials as shown in FIG. 1*b*. Preferably, the insulating material strip portion 2*b* includes a compressible material, for example putty or foam like material to better adapt to an uneven contour of the horizontal support structure. More preferably, the insulating material strip portion 2*a* includes a pressure-resistant material, which more preferably additionally is abrasion-resistant, for example a hard synthetic material on an acrylate basis. The insulating material strip portions 2*a* and 2*b* may on their surface include a cover layer 4 which may be a single layer that covers both insulating material strip portions 2*a* and 2*b*. Alternatively the cover layer 4 may also be divided into two portions 4*a* and 4*b* (encircled view in FIG. 1*b*; but not shown in FIG. 5). In the latter case the cover layer portion 4*a* covers the material strip portion 2*a* and cover layer portion 4*b* covers material strip portion 2*b*.

Figure 6:
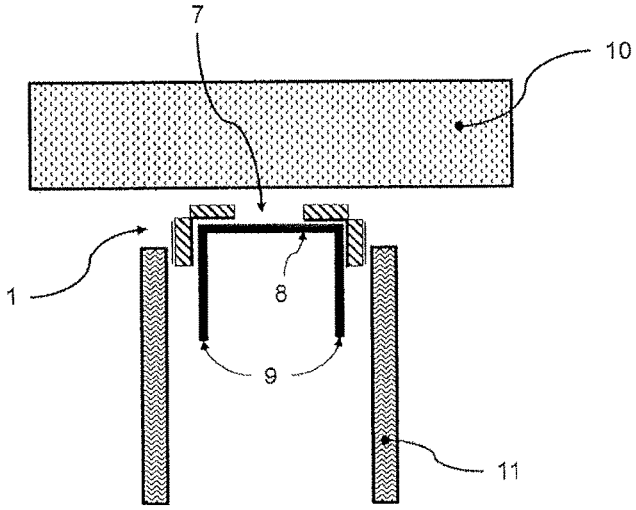
FIG. 6 is a cross-sectional view of a portion of a stud wall assembly with the insulating strip assembly of FIG. 1*c* installed at the head-of-wall in an alternative way according to another embodiment of the present invention.

In addition to or in the alternative, the insulating strip 1 shown in FIG. 1*c* which is divided into two portions 2*a* and 2*b* so that one portion (e.g., 2*b*) can be positioned on top of the header track 7, the web 8, and the other portion (e.g., 2*a*) can be positioned on the side of the header track 7, the leg 9, as shown in FIG. 6. This configuration is very similar to the configuration shown in FIG. 2, with the difference that the insulating strip 1 is the one which is shown in FIG. 1*c*. In this embodiment a cover layer may be omitted on the insulating material portion which is positioned on top of the web. Preferably and depending on the material used the insulating material portion that is positioned on the leg includes a cover layer to protect the insulating material, since this portion comes in direct contact with the wallboard.

Figure 7:
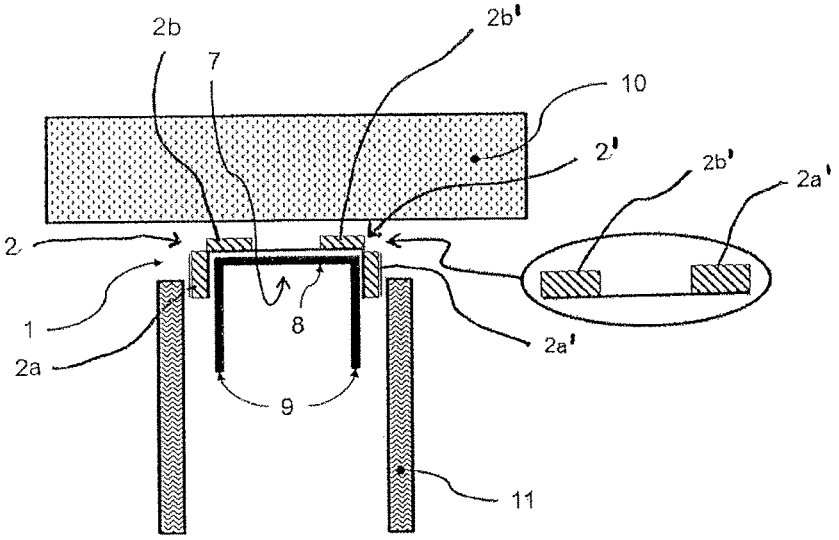
FIG. 7 is a cross-sectional view of an embodiment of a portion of a stud wall assembly with the insulating strip assembly of FIG. 1*d* installed at the head-of-wall in an alternative way according to another embodiment of the present invention.

FIG. 7 illustrates another embodiment of the invention, in which the insulating strip shown in FIG. 1*d* is applied to the header track 8. In this embodiment the insulating strip 1 comprises two separate insulating material portions that are arranged on opposing edge sections of the support layer 3 (see encircled section). Each insulating material portion 2 and 2' is divided into two portions 2*a*, 2*a'* and 2*b*, 2*b'* so that one part of the material portions (e.g., 2*b* and 2*b'*) can be positioned on top of the header track 7, on the web 8, and the other part of the material portions (e.g., 2*a* and 2*a'*) can be positioned on the side of the header track 7, on the leg 9. In this embodiment a cover layer may be omitted on the insulating material portions that are positioned on top of the web. Preferably and depending on the material used, the insulating material portions that are positioned on the leg each include a cover layer to protect the insulating material, since these portions come in direct contact with the wallboards.

Figure 8:
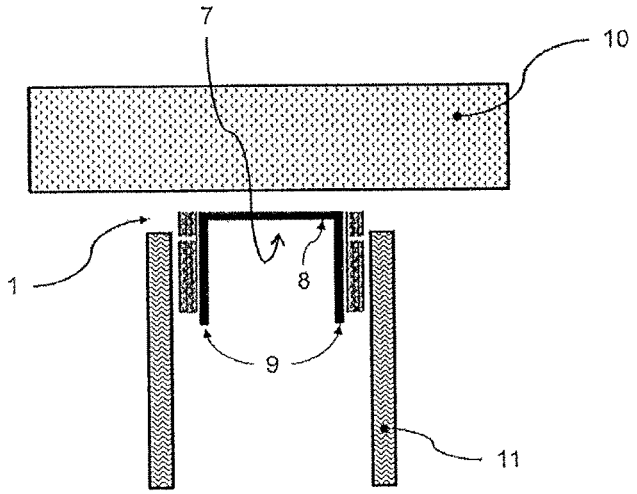
FIG. 8 is a cross-sectional view of an embodiment of a portion of a stud wall assembly with the insulating strip assembly of FIG. 1*c* installed at the head-of-wall in an alternative way according to another embodiment of the present invention.

FIG. 8 illustrates a further positioning of the insulating strip 1 shown in FIG. 1*c*, which arrangement is very similar to that shown in FIG. 3 with respect to the insulating strip 1 shown in FIG. 1*a*. The insulating strip 1 is affixed lengthwise on at least one, preferably both legs 9 of the header track 7. The insulating strip 1 is positioned so that its top edge 5 does not extend above the top surface of the web 8. In this configuration the insulating strip 1 does not necessarily contact the horizontal support structure 10, e.g. a ceiling. Alternatively, the insulating strip 1 may also extend above the top surface of the 8 to achieve a better sealing against the horizontal support structure 10, similar to the arrangement shown in FIGS. 4 and 5.

Figure 9A:
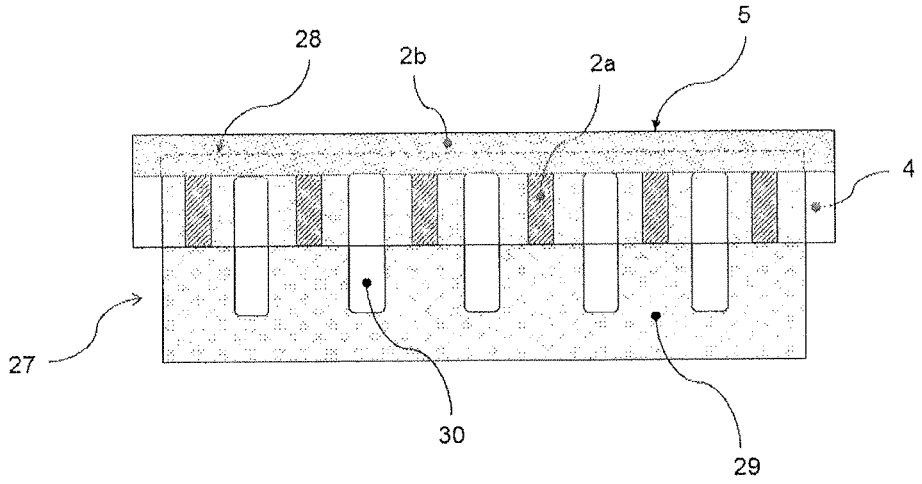
FIGS. 9*a* and 9*b* are side views of further embodiments of a portion of a stud wall assembly having a slotted track with a similar insulating strip assembly shown in FIG. 1*b* adapted to the slotted track installed at the head-of-wall according to another embodiment of the present invention.
Figure 9B:
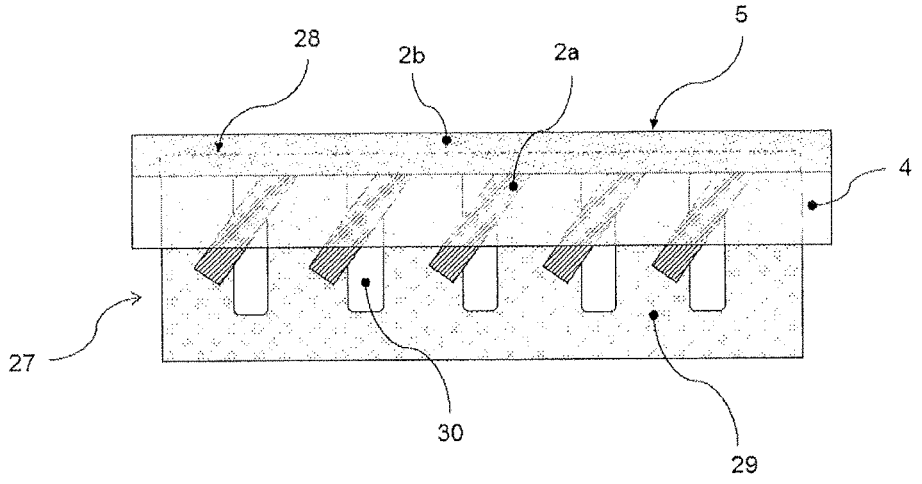

FIG. 9*a* illustrates a further embodiment of the insulating strip 1 applied to a slotted header track 27 having a plurality of slots 30. The insulating strip 1 is very similar to the one shown in FIG. 1*b* but is adapted to the slotted structure of the header track. The insulating material strip 2 of the insulating strip 1 is divided into two material portions 2*a* and 2*b* which include different materials. Preferably the material strip 2*a* includes a pressure-resistant and preferably also an abrasive-resistant material, for example an acrylate-based material. The material portion 2*b* preferably includes a compressible material, for example, a putty or a foamed material. Both material portions 2*a* and 2*b* are covered by a cover layer 4. The insulating strip 1 also includes a support layer 3. Preferably the material strips are provided with an adhesive (not shown) to secure the material strips to the support layer 3. In this embodiment, the material strip portion 2*a* is adapted to the slotted structure of the track 27 by subdividing the material strip portion 2*a* into a plurality of small stripes as best shown in FIG. 9*a* so that the material strip portion 2*a* is interrupted by portions free of insulating material 2. In other words, the insulating material portion 2*a* includes alternating portions with insulating material and portions free of insulating material. The portions with insulating material are aligned with leg 29 portions so that the portion of the material strip 2*a* free of insulating material is aligned with the slots 30. The thickness of the material strip depends on the screws or the like used to fix the studs (not shown) to the header track. Preferably the thickness of the insulating material corresponds to the thickness of the head of the screws protruding beyond the leg 29, whereas movement of the screw still must be possible. This provides sufficient sealing of the gap whilst ensuring at the same time a movement of the screws. The insulating strip may be installed before or after fixation of the header track and the studs. The insulating strip 1 is positioned so that its top edge 5 extends above the top surface of the web 28. In this configuration the insulating strip 1 contacts the horizontal support structure (not shown), e.g., a ceiling, and provides for enhanced sound and smoke containment especially in cases of an uneven or spawled horizontal support structure surface. The material stripes may also be positioned on the support layer 3 in such a manner that the stripes diagonally cover the slots 30 as best shown in FIG. 9*b*.

Figure 10:
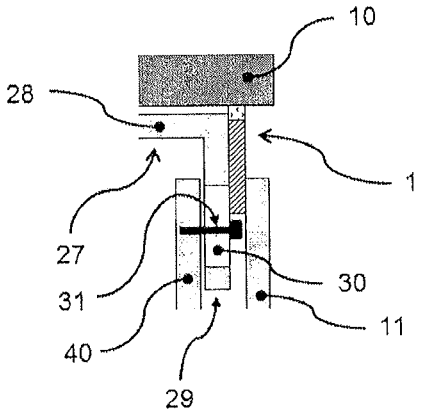
FIG. 10 is a cross-sectional view of a further embodiment of a portion of a stud wall assembly with the insulating strip installed at the head-of-wall according to FIGS. 9*a* and 9*b* according to another embodiment of the present invention.

Preferably the thickness of the insulating material 2 corresponds to the thickness of the head of the screws 31 protruding beyond the slotted leg 29, whereas movement of the screws 31 still must be possible when the wallboard 11 is fixed to the studs 40 as best shown in FIG. 10. The insulating strip 1 is positioned so that its top edge extends above the top surface of the web 28. In this configuration the insulating strip contacts the ceiling 10, and provides for enhanced sound and smoke containment especially in cases of an uneven or spawled horizontal support structure surface.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An insulating strip, comprising:

a support layer;

an insulating material strip secured to the support layer; and a cover disposed on the insulating material strip;

wherein the insulating material strip includes a first insulating material strip part and a second insulating material strip part;

wherein the first insulating material strip part and the second insulating material strip part are spaced apart from each other;

wherein the insulating material strip is a putty which includes an intumescent additive and the cover is a tape;

wherein the putty includes a reinforcing member;

wherein the reinforcing member is comprised of glass fibers or a glass fiber fabric.

2. The insulating strip according to claim 1:

wherein the cover includes a first cover part and a second cover part;

wherein the first cover part is disposed on the first insulating material strip part and the second cover part is disposed on the second insulating material strip part.

3. The insulating strip according to claim 1, wherein the first and the second insulating material strip parts have a same width.

4. The insulating strip according to claim 1, wherein a portion without an insulating material is disposed between the first and the second insulating material strip parts.

5. The insulating strip according to claim 1, wherein the insulating material strip includes a fire-resistant material and/or an acoustically insulating material.

6. A wall joint, comprising:

a header track with a web and a leg;

a horizontal support structure disposed apart from the header track; and an insulating strip, wherein the insulating strip includes:

a support layer; and an insulating material strip secured to the support layer;

wherein the insulating strip is attached to the header track;

wherein the insulating material strip includes a first insulating material strip part and a second insulating material strip part;

wherein the first insulating material strip part and the second insulating material strip part are spaced apart from each other;

wherein the insulating material strip is a putty which includes an intumescent additive, wherein the putty includes a reinforcing member, and wherein the reinforcing member is comprised of glass fibers or a glass fiber fabric.

7. The wall joint according to claim 6, further comprising a cover disposed on the insulating material strip.

8. The wall joint according to claim 7:

wherein the cover includes a first cover part and a second cover part;

wherein the first cover part is disposed on the first insulating material strip part and the second cover part is disposed on the second insulating material strip part.

9. The wall joint according to claim 6, wherein the first and the second insulating material strip parts have a same width.

10. The wall joint according to claim 6, wherein a portion without an insulating material is disposed between the first and the second insulating material strip parts.

11. The wall joint according to claim 6, wherein the insulating material strip includes a fire-resistant material and/or an acoustically insulating material.

12. The wall joint according to claim 6, wherein the first insulating material strip part is attached to the leg of the header track and the second insulating material strip part is attached to the web of the header track.

13. The wall joint according to claim 6:

further comprising a cover, wherein the cover is disposed on the first insulating material strip part and the cover is not disposed on the second insulating material strip part;

and wherein the first insulating material strip part is attached to the leg of the header track and the second insulating material strip part is attached to the web of the header track.

* * * * *